United States Patent [19]

George et al.

[11] Patent Number: 4,917,189

[45] Date of Patent: Apr. 17, 1990

[54] METHOD AND APPARATUS FOR PERFORATING A WELL

[75] Inventors: Flint R. George; David S. Wesson, both of Katy; Kevin R. George, Columbus, all of Tex.

[73] Assignee: Halliburton Company, Duncan, Okla.

[21] Appl. No.: 147,972

[22] Filed: Jan. 25, 1988

[51] Int. Cl.[4] ..... E21B 43/112

[52] U.S. Cl. ..... 166/297; 175/4.54

[58] Field of Search ..... 166/55, 55.1, 297; 175/4.54, 4.56

[56] References Cited

U.S. PATENT DOCUMENTS

| | | | |
|---|---|---|---|
| 4,484,632 | 11/1984 | Vann | 166/297 |
| 4,509,604 | 4/1985 | Upchurch | 175/4.52 |
| 4,523,643 | 6/1985 | McGlothen | 166/297 |
| 4,560,000 | 12/1985 | Upchurch | 166/55.1 |
| 4,564,076 | 1/1986 | Vann et al. | 175/4.52 |
| 4,655,298 | 4/1987 | George et al. | 175/4.52 |

FOREIGN PATENT DOCUMENTS

WO87/00903 6/1988 PCT Int'l Appl. .

OTHER PUBLICATIONS

Phoenix Petroleum Service Ltd.–"The Phoenix TCP/ESP Combination Using the Phoenix By-Pass System", (1988).

R. W. Dudley–"Reperforation of North Sea Electric Submersible Pump Wells Using an ESP/Y-Tool/TCP System", (1987).

Vannsystems Equipment–"Annulus Pressure Firing Head", (1987).

Vannsystems Equipment Firer—"Releasable Annulus Pressure Firer", (1987).

*Primary Examiner*—William P. Neuder

*Attorney, Agent, or Firm*—Arnold, White & Durkee

[57] ABSTRACT

A method and apparatus for perforating a subsurface formation in a pumped well. An assembly is provided which facilitates both the support of a pump in a tool string and the convection of fluid, and pressures, around the pump in the tool string. A firing head associated with the perforating gun is actuated by a pressure of differential between the tubing string bore and the wellbore annulus. This pressure differential is achieved by a downhole pump which pumps fluid out of the wellbore into the tubing string bore.

14 Claims, 4 Drawing Sheets

FIG.2E
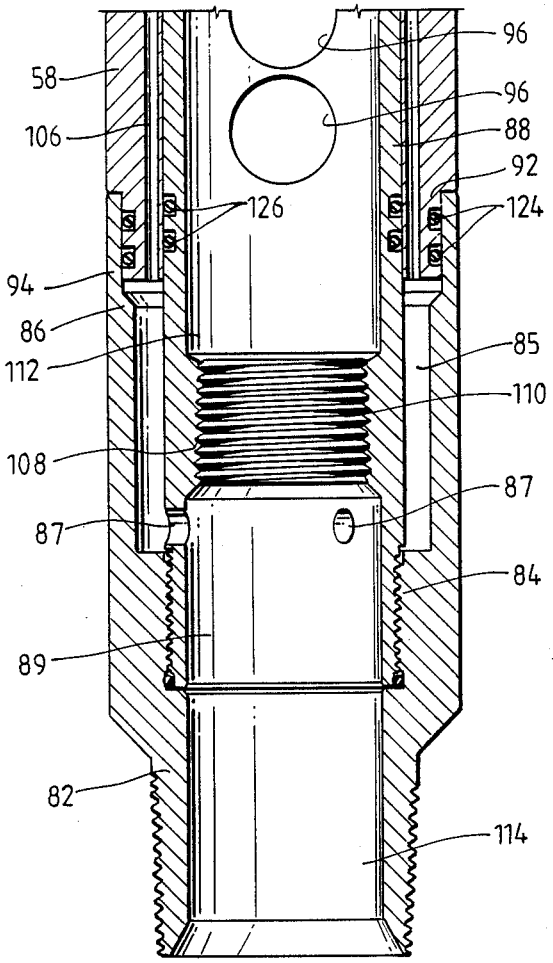
FIG.4
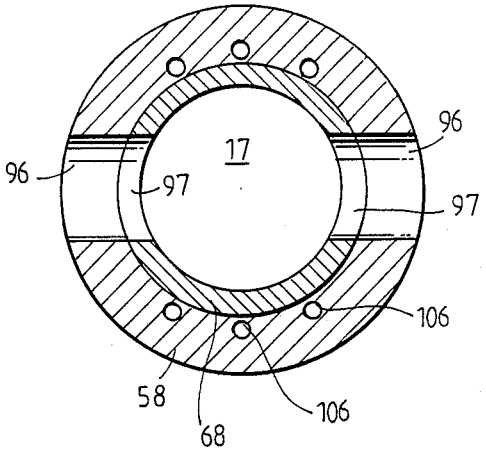
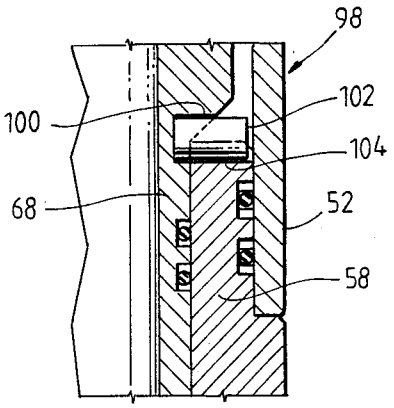
FIG.5

METHOD AND APPARATUS FOR PERFORATING A WELL

BACKGROUND OF THE INVENTION

The present invention relates generally to methods and apparatus for tubing conveyed perforating, and more specifically relates to methods and apparatus for perforating subsurface formations in a pumped well in response to a pressure differential between the tubing string and the wellbore annulus.

After an oil or gas well has been drilled, casing is typically placed in the well to line the side of the wellbore. Before a formation can be produced, it is necessary to perforate this casing and the formation. Under conventional practices, tubing conveyed perforating guns are lowered into the wellbore until they are in the area of the bore adjacent to the formation. A firing head associated with the perforating guns is then actuated, detonating the perforating guns and perforating the casing and the formation. The perforations allow the gas or oil in the formations to flow into the wellbore annulus. Often it is desirable to have a pressure underbalance between the formation and the wellbore annulus so that when the perforation occurs, the gas or oil in the formation immediately flows into the annulus, flushing out the perforations.

If the drive pressure of the formation is not sufficient to force the gas or oil to the surface through the tubing string, it is necessary to lower a pump into the wellbore to pump the fluids out. The withdrawal of the perforating equipment and placement of the pump requires that the well be killed. In some sensitive formations, once the well has been killed, the formations may not recover to their full, original producing capacity.

Accordingly, the present invention provides a method and apparatus whereby a perforating gun can be actuated by means of a pressure differential between the tubing string and the wellbore annulus with a pump in place in the tubing string, and whereby the formations surrounding the well can be perforated with a desired pressure differential to the well bore. Additionally, the pump may be utilized to establish the pressure differential to actuate the perforating gun.

SUMMARY OF THE INVENTION

In one preferred embodiment, the present invention provides an apparatus for completing a well by perforating and producing fluid from the well. In this preferred embodiment, the perforating gun is positioned on a tool string generally adjacent the formation to be perforated. The perforating gun has a firing head associated with it. In a particularly preferred embodiment, the firing head has a firing head mandrel slidably located within a firing head housing. The firing head mandrel is adapted to slide in response to a pressure imbalance across the mandrel, such pressure imbalance resulting from a pressure differential between the fluid in the wellbore annulus and the fluid in the tubing string bore. The mandrel will be initially retained, such as by shear pins, in a first, unactuated, position. When the pressure differential reaches a threshold level, the shear pins will shear, and the mandrel will slide, releasing a firing piston, and actuating an initiator charge in the firing head to detonate the perforating gun.

Also in a particularly preferred embodiment, the pressure differential is produced by a pump located in the well. The pump moves fluid from the wellbore annulus into the tubing string, establishing the pressure differential. In structure, the pump divides the tubing string into an upper tubing string bore and a lower tubing string bore. Fluid communication between the upper and lower tubing string bores is achieved by one or more bypass channels. In one preferred embodiment, these bypass channels comprise an annulus within the tubing string, located concentric to the pump, and axial channels located within a wall of the tubing string. In another preferred embodiment, the bypass channel comprises a y-block which divides the tubing string into first and second tubing strings. The pump is placed within the first tubing string and the perforating gun is attached to the second tubing string.

In operation of the particularly preferred embodiment described above, the perforating gun and its associated firing head assembly are positioned in the well adjacent a formation. A firing head mandrel is held in a first unactuated position by shear pins. A pump is situated in the tubing string. The pump draws fluid out of the wellbore annulus into the tubing string bore, creating a pressure differential between the fluid in the wellbore annulus and the fluid in the tubing string bore. When a predetermined pressure differential is achieved, the shear pins shear and the firing head mandrel moves, releasing the firing piston and detonating the perforating gun. As an alternative, the firing head may be actuated by applying pressure to the tubing string bore from the surface while the pump is situated within the tool string.

BRIEF DESCRIPTION OF THE DRAWINGS

FIGS. 2A–C depict elements of the pump assembly of FIG. 1 in greater detail and partially in vertical section.

FIG. 4 depicts a cross-section of a portion of the pump assembly of FIG. 2 taken along the lines 4—4.

FIG. 5 depicts in greater detail the alignment pin assembly of FIG. 2.

DETAILED DESCRIPTION OF THE PREFERRED EMBODIMENT

Figure 1:
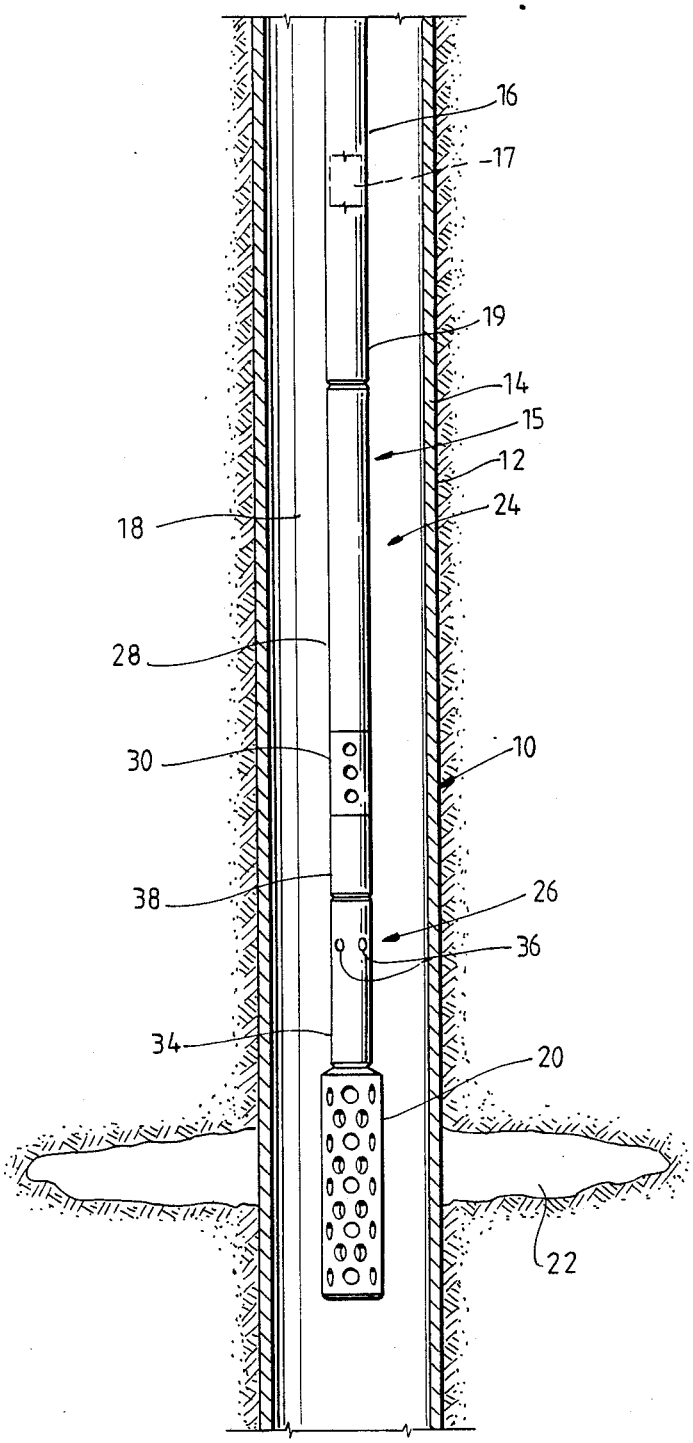
FIG. 1 schematically depicts a perforating assembly useful in a pumped well in accordance with the present invention, disposed within a well, illustrated partially in vertical section.

Referring now to FIG. 1 therein is schematically depicted one example of a perforating assembly 10 established in accordance with the present invention and situated inside a well 12 in which casing 14 has been set. Perforating assembly 10 is located at the lower end of a tool string 15 which includes tubing string 16. Well annulus 18 is formed between tool string 15 and the casing 14. Because well 12 is to be pumped, tool string 15 will typically not include a packer. One or more packers can, however, be utilized in tool string 15 if desired for a particular application.

Perforating assembly 10 preferably includes a perforating gun 20, a hydraulically-actuable firing head assembly 26, and a pump assembly 24. Perforating gun 20 is preferably located proximate the lower end of perforating assembly 10. In operation, perforating gun 20 is positioned in the well 12 adjacent a formation 22 to be perforated.

Pump assembly 24 is coupled to tubing string 16 and includes pump housing assembly 28. Pump housing assembly 28 includes a ported section 30 which provides fluid communication between tubing string bore 17 (extending through tool string 15),and well annulus 18. Additionally, pump housing assembly 28 facilitates the supporting of a pump within tool string 15 and the communication of pressures in tool string 15 between locations above and below the pump. Pump assembly 24 facilitates the pumping of fluid from well annulus 18 through ported section 30 into tubing string bore 17.

Firing head assembly 26 is located within a firing head housing 34. Ports 36 in firing head housing 34 provide fluid communication between well annulus 18 and a chamber inside firing head housing 34. As discussed below, ported section 30 and ports 36 enable firing head 26 to be actuated by a pressure differential between the fluid in well annulus 18 and the fluid in tubing string bore 17. Firing head housing 34 is coupled to pump housing assembly 28 by means of a coupling sub 38.

Figure 2A:
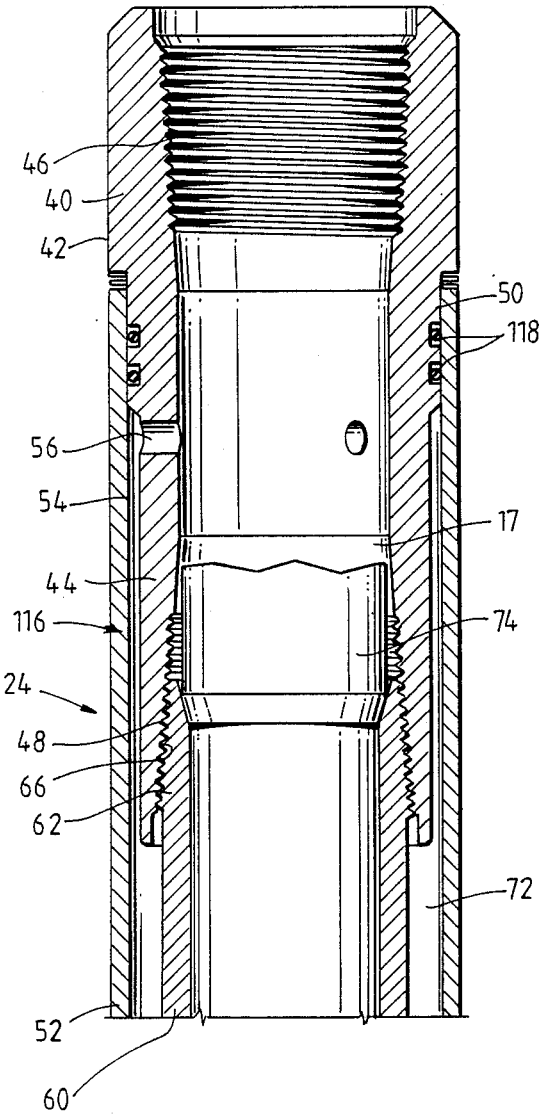
Figure 2B:
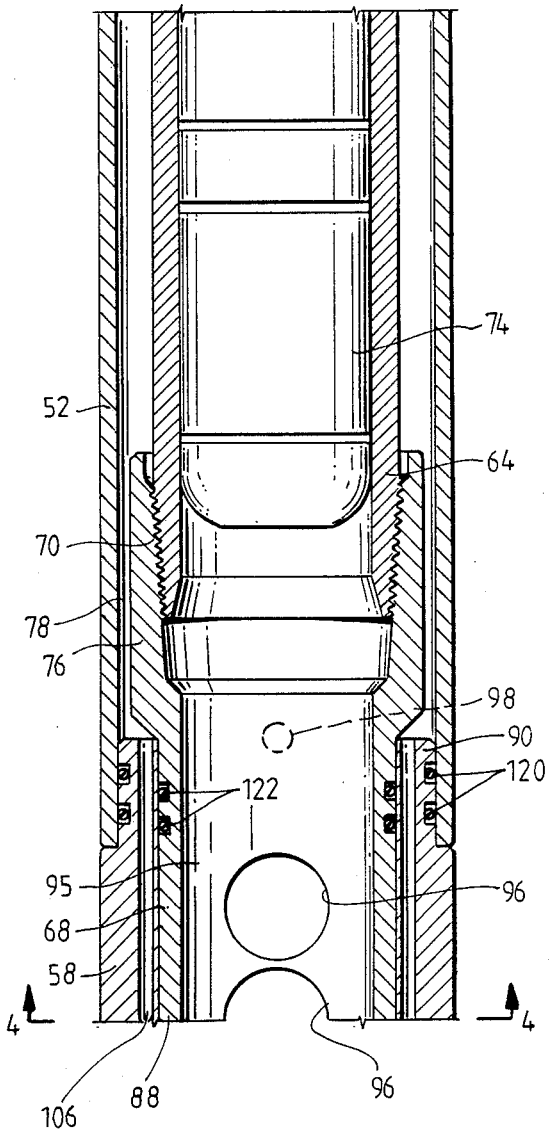

Referring now to FIGS. 2A–C, shown therein in greater detail is pump assembly 24. Pump assembly 24 is configured to support pump 74 and to facilitate the pumping operation, while also facilitating fluid flow in tubing string 16 and around pump 74 prior to perforation of the well. A sub 40 is located at the upper end of the pump assembly 24. Sub 40 has an upper end 42 and a lower end 44. A threaded box connector 46 is located at the upper end 42 of the sub 40 for connecting sub 40 to tubing string 16. Sub 40 includes another threaded box connector 48 proximate its lower end 44. The longitudinal tubing string bore 17 extends through the sub 40. The lower end 44 of the sub 40 has a reduced outside diameter relative to the outside diameter of upper end 42 of sub 40. Sub 40 has an intermediate region 50 which has an outside diameter which is less than the outside diameter of upper end 42, but which is greater than the outside diameter of lower end 44. A generally cylindrically shaped pump housing member 52 is adapted to engage with intermediate region 50 of sub 40. The inside diameter of the pump housing member 52 is greater than the outside diameter of lower end 44 of sub 40, forming a tool annulus 54 between pump housing member 52 and sub 40. Ports 56 in sub 40 permit fluid communication between tubing string bore 17 and tool annulus 54. At the end opposite sub 40, pump housing member 52 engages a sleeve 58.

Concentrically located within pump housing member 52 is a pump seating nipple 60. Pump seating nipple 60 has an upper end 62 and a lower end 64. A threaded pin connector 66 is formed at the upper end 62 of pump seating nipple 60, and is adapted to be threaded to a lower threaded box connector 48 on the lower portion of sub 40. Lower end 64 of pump seating nipple 60 engages a mandrel 68 by means of a similar box-pin connection 70. The outside diameters of pump seating nipple 60 and mandrel 68 are again less than the inside diameter of the pump housing member 52, to continue annulus 54 between pump seating nipple 60 and pump housing member 52. In operation, a pump 74 is seated within pump seating nipple 60 in a conventional manner. The pump 74 may be one of many conventional designs known to the art, but preferably is a rod pump.

Mandrel 68 has a lower end 80 which is threaded onto bottom sub 82 by means of a box-pin connection 84. Sub 82 has an upper end 86 located concentric to, and radially outwardly spaced from, lower end 80 of mandrel 68. The outside diameter of lower end 80 of mandrel 68 is less than the inside diameter of upper end 86 of sub 82, forming an annulus 85 between mandrel 68 and sub 82. Ports 87 provide fluid communication between annulus 85 and the interior bore 89 of mandrel 68. Mandrel 68 has an intermediate region 88 between the upper end 76 and the lower end 80 of the mandrel 68. Lower end 80 of mandrel 68 is provided with interior threading 108. This interior threading is adapted to receive a plug 110, which divides tubing string bore 17 into an upper tubing bore 112 and a lower tubing bore 114.

Referring now also to FIG. 4, a sleeve 58 is positioned around the intermediate region 88 of the mandrel 68. Sleeve 58 has an upper end 90 and a lower end 92. Upper end 90 of the sleeve 58 is adapted to sealingly engage pump housing member 52, while lower end 92 is adapted to sealingly engage a projection 94 on upper end 86 of sub 82. Sleeve 58 includes a plurality of axial channels 106 to facilitate fluid communication between annulus 54 and annulus 85. These axial channels 106 are circumferentially spaced from the ports 97. Ports 56, tool annulus 54, axial channels 106, annulus 85, and ports 87 cooperatively form a bypass channel, indicated generally at 116, to provide fluid communication between the upper tubing bore 112 and lower tubing bore 114 around pump 74. Seals 118, 120, 122, 124, and 126 prevent leakage from the bypass channel 116.

To provide fluid communication between the interior 95 of mandrel 68 and the wellbore annulus (18 in FIG. 1), radial production ports 96 and 97 are provided in mandrel 68 and sleeve 58, respectively. Ports 96, 97 provide fluid communication between the tubing string bore 17 and the wellbore annulus 18. To ensure that mandrel 68 and sleeve 58 are circumferentially aligned, to allow fluid communication through ports 96, 97, an alignment pin assembly 98 is provided.

Alignment pin assembly 98 is best seen in FIGS. 2 and 5. Alignment pin assembly 98 is preferably located at upper end 90 of sleeve 58, and preferably includes a hollow cylindrical seat 100 located in the mandrel 68. Seat 100 is adapted to receive a cylindrical alignment pin 102. A notch 104 is formed in the upper end 90 of the sleeve 58. The notch 104 is adapted to be engaged by alignment pin 102 when mandrel 68 and sleeve 58 are circumferentially aligned.

In an alternative embodiment, a gas anchor (not shown) may extend downward from pump 74 through lower tubing bore 114 within lower bottom sub 82. The gas anchor would be surrounded by a gas anchor housing (not shown), which is threaded onto the interior threading 108 of mandrel 68. The gas anchor housing would replace plug 110 in dividing the tubing string bore 17 into an upper tubing bore 12 and a lower tubing bore 114.

Figure 3A:
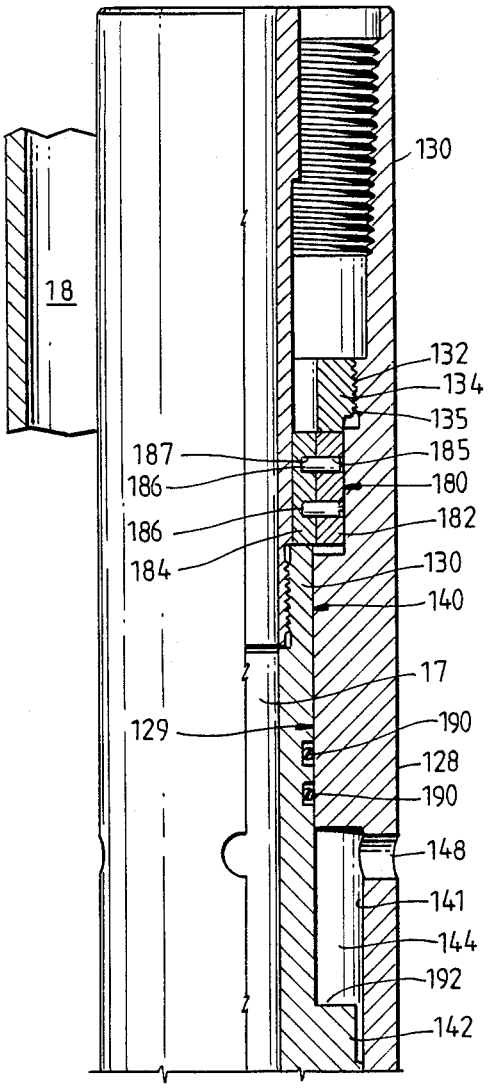
FIGS. 3A–B depict the firing head assembly of FIG. 1 in greater detail and partially in vertical section.
Figure 3B:
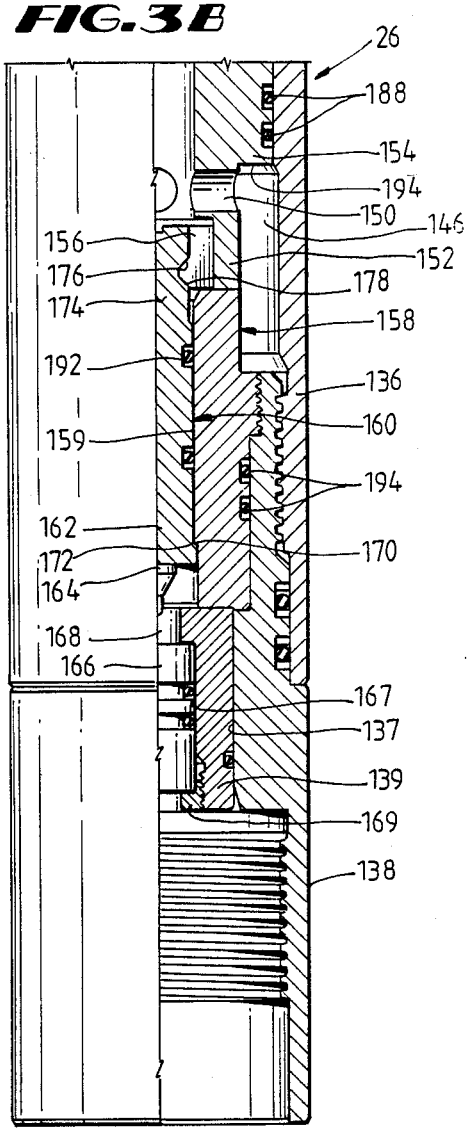

Referring now to FIGS. 3A–B, therein is depicted an exemplary embodiment of a firing head in accordance with the present invention, depicted partially in vertical section. Firing head 26 is actuated by differential pressure between the well annulus and the interior of the tubing. Unlike other, conventional, differential pressure-actuated firing heads, however, firing head 26 does not require any drive pressure, in either the tubing or the annulus, other than the actuation pressure to actuate it. Firing head 26 includes an upper firing head housing 128 adapted to be attached at its upper end 130 to a tubing joint 19 in tool string 15. Upper firing head housing 128 is threadably coupled to lower firing head housing 138, which is, in turn, adapted to be coupled to a perforating gun in a conventional manner. The upper firing head housing 128 includes interior threads 132 adapted to engage a retainer ring 134, as discussed below. The lower end 136 of the upper firing head housing 128 is threaded onto a lower firing head housing 138.

A firing head mandrel 140 is slidably and sealingly received in upper firing head housing 128. Firing head mandrel 140 preferably sealingly engages an inner projection 129 within upper firing head housing 128. Additionally, a projection 142 extends from the body of firing head mandrel 140 and slidingly and sealingly engages an interior surface 141 of upper firing head housing 128. Projection 142 on firing head mandrel 140 and projection 129 on firing head housing 128 cooperatively define an upper annular chamber 144. Radial ports 148 in upper firing head housing 128 provide fluid communication between the wellbore annulus 18 and upper annular chamber 144.

An annular piston retainer 158 is threadably coupled to lower firing head sub assembly 138 and is adapted to contact skirt 152 of firing head mandrel 140 and to prevent downward movement of firing head mandrel 140 from its first, unactuated position. Projection 142 on firing head mandrel 140, upper firing head housing 128, lower firing head housing 138 and piston retainer 158 cooperatively define a lower annular chamber 146. Radial ports 150 in the firing head mandrel 140 provide fluid communication between the tubing string bore 17 and lower annular chamber 146. The described configuration allows firing head mandrel 140 to function as an upwardly movable piston responsive to a pressure differential between the interior of the tubing string (communicated to lower annular chamber 146), and the borehole annulus (communicated to upper annular chamber 144). The upward movement of firing head mandrel 140 serves to assure that mandrel 140 will not inadvertently be prematurely released by mechanical shock as firing head 26 is lowered in the well.

Piston retainer 158 includes a bore 159, in which a generally cylindrically shaped firing piston 160 is slidingly and sealingly received. Lower firing head housing 138 includes a bore 137 in which an initiator block 139 is sealingly received. Initiator block 139 receives an initiator charge 166 in an internal bore 167. Initiator 166 is sealingly received within initiator block 139 and is preferably retained in place by any suitable mechanism, for example, retaining ring 169. Because of the described sealing engagements, a chamber 168 is formed between initiator 166 and firing piston 160 which will be at atmospheric pressure.

Firing piston 160 includes a firing pin 164 at its lower end. Firing pin 164 is adapted to be driven into initiator 166, thereby causing an explosion which will detonate a perforating gun, resulting in perforation of the well in a conventional manner. Firing piston 160 has a radial projection 170 proximate its lower end 162. The projection 170 cooperates with a radial recess 172 in piston retainer 158 to limit upward movement of firing piston 160 after initiator 166 is detonated.

Firing pin 160 is initially retained in a first, unactuated position by cooperative action of skirt 152 on firing head mandrel 140 and a plurality of latching "dogs" 156. Firing piston 160 includes a peripheral groove 176 proximate its upper end 174. Groove 176 is cooperatively engaged by inwardly extending lips 178 on latching dogs 156. Dogs 156 are retained in engagement with groove 176 by skirt 152. When latching dogs 156 are engaged with groove 176, they prevent movement of the firing piston 160 and therefore retain the firing piston 160 in an unactuated position, as depicted in FIG. 3.

Firing head mandrel 140 is retained in the fully downward, unactuated position, as depicted in FIG. 3, by means of a shear pin assembly, indicated generally at 180. Shear pin assembly 180 includes an outer shear block 182 and an inner shear block 184. Shear pins 186 engage apertures 185, 187 in outer shear block 182 and inner shear block 184, respectively. The upper end 130 of firing head mandrel 140 abuts against inner shear block 184. Outer shear block 182 is retained in position in upper firing head housing 128 by a retainer ring 134 which is threaded at 135 to upper firing head housing 128. Shear pins 186 therefore retain firing head mandrel in a first, unactuated, position. The strength of shear pins 186 will be determined by the amount of pressure differential that is desired to be required to actuate the firing head assembly 26. In a preferred embodiment, shear pins 186 will be established to release firing head mandrel 140 when a minimum pressure differential of 650 psi. is realized.

The operation of the firing head assembly 26 is as follows. At the beginning of the perforating operation, upper annular chamber 144 is in fluid communication with wellbore annulus 18 through ports 148, and fluid pressure in upper annular chamber 144 is therefore equal to the fluid pressure in wellbore annulus 18. Lower annular chamber 146 is in fluid communication with the tubing string bore 17 through the ports 150. Because the pressure of the fluid in the wellbore annulus, and therefore in upper annular chamber 144, will be equal to the pressure of the fluid in the tubing string (and therefore in lower annular chamber 146), firing head mandrel will be pressure balanced and will be retained in its first, unactuated, position by shear pin assembly 180.

As firing head mandrel 140 is retained in its fully downward position by shear pin assembly 180, skirt 152 prevents radially outward movement of the latching dogs 156, and lips 178 of latching dogs 156 engage groove 176 of firing piston 160 and prevent downward movement of firing piston 160.

When the fluid pressure in tubing string bore 17 exceeds the fluid pressure in wellbore annulus 18, the pressure across firing head mandrel 140 becomes unbalanced and urges firing head mandrel 140 in an upward direction. When the upward force on firing head mandrel 140 exceeds the established shear strength of shear pins 186, shear pins 186 shear and firing head mandrel 140 moves upwardly. When skirt 152 moves upward, latching dogs 156 are no longer radially restrained by skirt 152 and fall away from firing piston 160. Firing piston 160 is released and fluid pressure in tubing string bore 17 forces firing piston 160 downward. Firing pin 164 contacts initiator 166 and initiates the perforating gun detonation in a conventional manner.

As an alternative, a conventional time delay firing device may be used in place of, or in connection with, initiator 166 to delay the firing of the perforating gun after actuation of the firing head assembly. One such type of time delay firing mechanism is Vann Systems' type TDF firer which incorporates a time delay fuse to delay detonation. The TDF time delay firing device is disclosed in U.S. Pat. No. 4,632,034, issued Dec. 30, 1986 to Collie. The specification of U.S. Pat. No. 4,632,034 is hereby incorporated by reference herein for all purposes.

In a preferred method of practicing the invention, the pump which will later be utilized to produce the well will also be utilized to establish the pressure differential in favor of the tubing string to actuate firing head 26. Pump 74 will be actuated to pump fluid from wellbore annulus 18, through ports 96, 97, and into tubing string bore 17, thereby decreasing the hydrostatic pressure of the fluid in wellbore annulus 18. When the fluid level in the annulus has been pumped down sufficiently to establish this actuation differential, shear pins 186 will shear and firing head 26 will operate as described above.

The shear pins 186 can be designed to withstand various pressure differentials between the fluids in upper annulus 144 and lower annulus 146. For example, shear pins 186 can be selected to withstand the force equal to the pressure of the entire fluid column in the wellbore annulus 18 above the pump assembly. In such a case, shear pins 186 will shear when the fluid in the wellbore annulus 18 has been lowered to the depth of ports 96, 97. In this manner, a maximum pressure underbalance between the wellbore annulus 18 and the formation will be achieved before the perforation. Additionally, firing head 26 may be actuated by shutting-in the tubing string at the surface, actuating the pump, and allowing the pump to thereby increase the pressure in the shut-in tubing to achieve the actuation pressure of firing head 26. Firing head 26 can also be actuated by pressuring down the tubing string from the surface.

As an alternative, a fluid bypass around the pump may be provided by apparatus other than the pump assembly set forth above. For example, the bypass channel may be a hydraulic control line which extends outside the tubing string between two conventional control line connections in the tubing string situated above and below the pump assembly.

Figure 6:
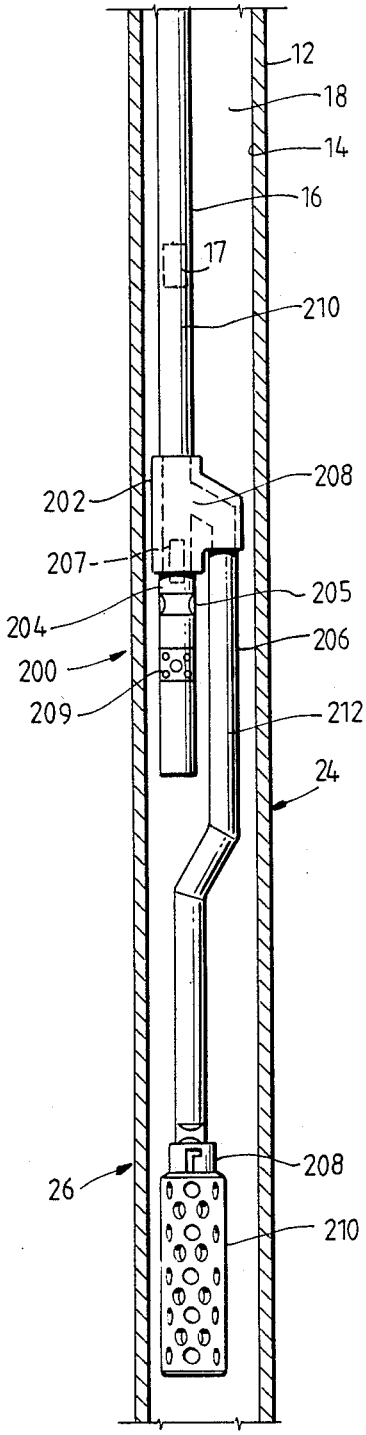
FIG. 6 schematically depicts an alternative embodiment of a perforating assembly in accordance with the present invention.

Referring now to FIG. 6, therein is shown an alternative embodiment of a perforating equipment assembly 200 in accordance with the present invention, wherein a secondary tubing string, rather than a fluid bypass in a single string, is utilized to provide tubing string pressure to the firing head. Coupled to tubing string 16 is a Y-block 202. Y-block 202 divides the tubing string 16 into two tubing strings, a primary tubing string 204 and a secondary tubing string 206. Primary tubing string 204 includes a pump seating nipple 205, in which a pump 207 is seated. Primary tubing string 204 also includes a ported member 209 to allow fluid flow into primary string 204. Ported member 209 may be a ported sub, a gas anchor, or other appropriate device. Secondary tubing string 206 includes a firing head 208 and perforating gun 210. Firing head 208 is preferably of a type as described above in association with FIGS. 3A–B.

In operation, perforation assembly 200 functions similarly to the perforation assembly of FIGS. 1–5. Y-block 202 allows fluid communication between the upper tubing bore 210, located above pump 207, and the lower tubing bore 212 in secondary tubing string 206. Accordingly, fluid pressure in tubing string bore 17 above Y-block 202, is transmitted to firing head 208. As described with respect to the embodiment of FIGS. 1–5, actuation of pump 207 will pump fluid from the well annulus and will establish a pressure differential in favor of the tubing string to facilitate actuation of firing head 208, and the detonation of perforating gun 210.

Many modifications and variations may be made in the techniques and structures described and illustrated herein without departing from the spirit and scope of the present invention. For example, apparatus other than those described herein may be utilized to provide fluid communication from above pump assembly to beneath the pump assembly. Additionally, as discussed with respect to FIG. 6, a gas anchor may be utilized to facilitate fluid flow to the pump. Accordingly, the techniques and structures described herein are illustrative only and are not to be considered as limitations upon the scope of the present invention.

What is claimed is:

1. A method of comprising a well penetrating a subsurface formation, comprising:

suspending a perforating gun from a tubing string in said well, said perforating gun placed proximate said formation;

placing a pump assembly in said tubing string;

operating said pump assembly to produce a preselected pressure imbalance between a well annulus, which surrounds said perforating gun, and said tubing string;

actuating said perforating gun to perforate said formation, said perforating gun being actuated by said preselected pressure imbalance;

utilizing said pump assembly to pump fluid from said formation.

2. The method of claim 1 wherein the perforating gun and the pump assembly are attached to a tubing string having a tubing string bore, the tubing string forming a wellbore annulus, the pressure imbalance being formed by a pressure differential between the fluid in the tubing string bore and the fluid in the wellbore annulus.

3. A method of completing a well, comprising:

placing a perforating gun and firing head assembly in said well, said perforating gun being associated with a tubing string and said perforating gun being actuable by a pressure imbalance between the interior and exterior of said tubing string;

placing a pump in said well;

actuating said pump to establish a sufficient pressure imbalance to actuate said perforating gun.

4. The method of claim 3, wherein said pump is further utilized to pump fluid from said perforated formations through said well.

5. The method of claim 3, wherein said pump moves fluid from the exterior of said tubing string to the interior of said tubing string to establish said pressure imbalance.

6. A tool string for use in perforating a well, comprising:

a perforating gun;

a hydraulically actuated firing head responsive to a hydraulic pressure differential, said firing head cooperatively coupled with said perforating gun to actuate said perforating gun when a specified pressure differential is achieved;

a pump cooperatively arranged in said tool string to establish said pressure differential to actuate said firing head.

7. The tool string of claim 6 wherein the pump is further adapted to pump fluid from a perforated formation.

8. The tool string of claim 6 further comprising a pump housing assembly proximate said pump, wherein said pump housing assembly provides a flow path in said tool string from above said pump to below said pump.

9. The tool string of claim 6 wherein the pump is located in said tool string above said perforating gun.

10. The tool string of claim 6, which further comprises:

a first tubing string in which said pump is located; and a second tubing string operatively coupled to said first tubing string, said perforating gun and said firing head being operatively coupled to said second string.

11. Apparatus for producing fluid from a well penetrating a subsurface formation, comprising:

a perforating gun coupled to a tubing string, said perforating gun having a firing head associated therewith, said firing head actuable by a predetermined hydraulic pressure differential between the interior and exterior of said tubing string; and a pump in fluid communication with said firing head, said pump actuable to establish said predetermined hydraulic pressure differential to actuate said firing head.

12. The apparatus of claim 11 wherein said pump is further adapted to pump fluid from said formation after perforation of the formation.

13. The apparatus of claim 11, wherein said firing head includes a mandrel which is movable generally upwardly by said differential hydraulic pressure to actuate said perforating gun.

14. The apparatus of claim 13, further comprising stop means for limiting the upward movement of said piston.

* * * * *

UNITED STATES PATENT AND TRADEMARK OFFICE

CERTIFICATE OF CORRECTION

PATENT NO. : 4,917,189

DATED : April 17, 1990

INVENTOR(S) : Flint R. George, et al.

It is certified that error appears in the above-identified patent and that said Letters Patent is hereby corrected as shown below:

In column 8, line 14, delete "comprising" and replace with --completing--.

Signed and Sealed this

Seventh Day of May, 1991

*Attest:*

HARRY F. MANBECK, JR.

*Attesting Officer*

*Commissioner of Patents and Trademarks*